US007999771B2

(12) United States Patent
Kawashima

(10) Patent No.: US 7,999,771 B2
(45) Date of Patent: Aug. 16, 2011

(54) ORGANIC LIGHT EMITTING DISPLAY AND DRIVING METHOD THEREOF

(75) Inventor: Shingo Kawashima, Ulsan (KR)

(73) Assignee: Samsung Mobile Display Co., Ltd., Yongin-city (KR)

( * ) Notice: Subject to any disclaimer, the term of this patent is extended or adjusted under 35 U.S.C. 154(b) by 304 days.

(21) Appl. No.: 11/693,603

(22) Filed: Mar. 29, 2007

(65) Prior Publication Data

US 2008/0007495 A1 Jan. 10, 2008

(30) Foreign Application Priority Data

Jul. 7, 2006 (KR) ..... 10-2006-0063940

(51) Int. Cl.
*G09G 3/32* (2006.01)

(52) U.S. Cl. ..... 345/82; 345/80; 345/76; 315/169.3

(58) Field of Classification Search ..... 345/76–83
See application file for complete search history.

(56) References Cited

U.S. PATENT DOCUMENTS

| | | | | |
|---|---|---|---|---|
| 6,323,631 | B1 | 11/2001 | Juang | |
| 6,473,064 | B1 | 10/2002 | Tsuchida et al. | |
| 2002/0101179 | A1 * | 8/2002 | Kawashima | 315/169.3 |
| 2004/0104686 | A1 | 6/2004 | Shin et al. | |
| 2005/0270258 | A1 * | 12/2005 | Shin | 345/76 |
| 2006/0071884 | A1 * | 4/2006 | Kim | 345/76 |
| 2007/0257867 | A1 * | 11/2007 | Kasai | 345/77 |

FOREIGN PATENT DOCUMENTS

| | | | |
|---|---|---|---|
| CN | 1620207 | A | 5/2005 |
| CN | 1643563 | A | 7/2005 |
| CN | 1645459 | A | 7/2005 |
| CN | 1710636 | A | 12/2005 |
| JP | 1999231834 | * | 8/1999 |
| JP | 11-305730 | | 11/1999 |
| JP | 2002-202754 | | 7/2002 |

(Continued)

OTHER PUBLICATIONS

Korean Patent Abstracts corresponding to Registered Korean Patent 10-0432173; Publication No. 10200225734 A; Publication Date: Apr. 4, 2002; in the name of Kawashima Shingo.

(Continued)

*Primary Examiner* — Bipin Shalwala
*Assistant Examiner* — Kelly Hegarty
(74) *Attorney, Agent, or Firm* — Christie, Parker & Hale, LLP

(57) ABSTRACT

An organic light emitting display includes column lines for receiving a drive current, each column line belonging to one of groups. Row lines are for receiving a scan signal. Organic light emitting diodes of pixels are at crossings of the row and column lines. A data driver includes a common current source and drive switching elements. The common current source is for applying the drive current to the column lines in one group. The drive switching elements are connected to the common current source and are for applying the drive current to the column lines in said one group within a drive period in which the scan signal is applied. Charge switches connected to the column lines are turned-on before the drive current is applied to the column lines, and turned-off during the drive period. A voltage retaining circuit coupled with the charge switches is for preliminarily charging the pixels.

19 Claims, 5 Drawing Sheets

FOREIGN PATENT DOCUMENTS

| | | | |
|---|---|---|---|
| JP | 2003-114645 | | 4/2003 |
| JP | 2003-167556 | | 6/2003 |
| JP | 2003-177722 | | 6/2003 |
| JP | 2003-255903 | | 9/2003 |
| JP | 2006-126232 | | 5/2006 |
| KR | 10-0432173 | | 5/2004 |
| KR | 10-2005-0034113 | | 4/2005 |
| KR | 1020050034113 | * | 4/2005 |
| KR | 10-2005-0105388 | | 11/2005 |
| KR | 1020050105388 | * | 11/2005 |
| KR | 10-2006-0018766 | | 3/2006 |
| KR | 1020060018766 | * | 3/2006 |
| KR | 10-2006-0064129 | | 6/2006 |
| KR | 1020060064129 | * | 6/2006 |

OTHER PUBLICATIONS

Patent Abstracts of Japan, Publication No. 2002-202754; Date of Publication: Jul. 19, 2002; in the name of Shingo Kawashima.

Korean Patent Abstracts, Publication No. 1020050105388 A; Date of Publication: Nov. 4, 2005; in the name of Hoon Ju Chung, et al.

Korean Office Action dated Jul. 31, 2007 for corresponding Korean Patent Application No. 10-2006-0063940.

European Search Report dated Aug. 18, 2009, for corresponding European application 07251686.7, noting listed references in this IDS.

English translation of Korean Office action dated Jul. 31, 2007, previously filed Oct. 15, 2007.

SIPO Patent Gazette dated Aug. 11, 2010, for corresponding Chinese Patent application200710128338.5, noting listed references in this IDS.

Japanese Office action dated Jun. 15, 2010 issued to corresponding application No. JP 2006-343292, listing the cited references in this IDS except JP 2002-202754 which was previously cited in an IDS on Oct. 15, 2007.

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application No. 10-2006-0063940, filed on Jul. 7, 2006, in the Korean Intellectual Property Office, the entire content of which is incorporated herein by reference.

BACKGROUND

1. Field of the Invention

The present invention relates to an organic light emitting display and a driving method thereof.

2. Discussion of Related Art

Recently, among various display devices, organic light emitting display devices have been proposed as the next-generation emissive display devices. Such organic light emitting display devices emit light by an electric field applied across an organic light emitting diode of a pixel.

FIG. 1 is a cross-sectional view showing a pixel of a conventional organic light emitting display. FIG. 2 is an equivalent circuit diagram of the pixel shown in FIG. 1.

With reference to FIG. 1, the pixel 1 includes a metal electrode 101, a transparent electrode 102, an organic phosphorous layer 103, and an organic hole transport layer 104. The metal electrode 101 functions as a cathode, and the transparent electrode 102 functions as an anode. The organic phosphorous layer 103 and the organic hole transport layer 104 are laminated between the metal electrode 101 and the transparent electrode 102. The organic phosphorous layer 103 and the organic hole transport layer 104 are made of organic compounds.

A glass substrate 105 is located at an outer side of the transparent electrode 102. A voltage from a drive source 106 is applied between the metal electrode 101 and the transparent electrode 102. Energy is discharged by excitons generated by recombination of electrons and holes, which are respectively introduced from the metal electrode 101 and the transparent electrode 102. Accordingly, the pixel 1 can emit light to an exterior through the transparent electrode 102 and the glass substrate 105. Since the pixel 1 has a structure in which the organic phosphorous layer is laminated between the electrodes, an equivalent electric circuit diagram thereof has parasitic capacitances. In more detail, as shown in FIG. 2, the pixel 1 includes an illuminant (or a light emitting element) 107 and a parasitic capacitance 109, which are connected with each other in parallel.

FIG. 3 is a schematic view showing a conventional organic light emitting display. FIG. 4 is a timing diagram showing application of a drive current for driving the organic light emitting display shown in FIG. 3.

With reference to FIG. 3 and FIG. 4, the conventional organic light emitting display includes an organic light emitting display panel 2, a controller 21, a scan driver 6, and a data driver 5.

In the organic light emitting display panel 2, column lines D1, D2, . . . , Dm and row lines S1, S2, . . . , Sn cross each other at predetermined intervals. Pixels 1, namely, organic light emitting diodes, are formed at crossings of the column lines D1, D2, . . . , Dm and the row lines S1, S2, . . . , Sn.

The controller 21 processes externally inputted image signals $S_{IM}$, and provides data control signals $S_{DA}$ and scan control signals $S_{SC}$ to the data driver 5 and the scan driver 6, respectively. Here, the data control signals $S_{DA}$ include data signals, and the scan control signals $S_{SC}$ include switching control signals to generate a scan signal. The data driver 5 is electrically connected to the column lines D1, D2, . . . , Dm. The data driver 5 generates and provides a drive current corresponding to the data signals from the controller 21 to the column lines D1, D2, . . . , Dm according to the data control signals $S_{DA}$ from the controller 21.

The scan driver 6 is electrically connected to the row lines S1, S2, . . . , Sn. The scan driver 6 sequentially provides a scan signal to the row lines S1, S2, . . . , Sn according to the switching control signals $S_{SC}$ from the controller 21.

As shown in FIG. 4, during a drive period Td of an organic light emitting diode in one pixel, a ground voltage switching element (see, for example, $M_{g1}$, in FIG. 3) is turned-on to apply a ground voltage to a row line. During time periods except for the drive period, a scan voltage switching element (see, for example, $M_{S1}$ in FIG. 3) is turned-on to apply a scan voltage to the row line. As shown in FIG. 4, during the drive period Td, a drive current is applied to a column line corresponding to a pixel. That is, during a drive period Td of a first row line S1, drive currents I1, I2, . . . , Im are respectively applied to the column lines D1, D2, . . . , Dm and flow through the respective pixels 1. As shown in FIG. 4, because the pixel 1 is equivalently represented by the illuminant 107 and the parasitic capacitance 109 connected in parallel with each other (see, for example, FIG. 2), the drive currents I1, I2, . . . , Im are divided into first drive currents Ic1, Ic2, . . . , Icm and second drive currents Id1, Id2, . . . , Idm. The first drive currents Ic1, Ic2, . . . , Icm function to charge the respective parasitic capacitances 109, whereas the second drive currents Id1, Id2, . . . , Idm are supplied to the respective illuminants 107 after a charge of the corresponding parasitic capacitances 109. FIG. 4 shows drive currents I1, I2, I3, and I4, which are respectively applied to a first column line D1, a second column line D2, a third column line D3, and a fourth column line D4.

Japanese patent publication No. 1999-231834 discloses an organic light emitting display and a driving method thereof as described above.

However, in Japanese patent publication No. 1999-231834, since the data driver 5 should include a circuit to generate the drive currents I1, I2, . . . , Im respectively applied to the column lines D1, D2, . . . , Dm, a manufacturing cost is increased.

SUMMARY OF THE INVENTION

Accordingly, aspects of the present invention respectively provide an organic light emitting display and a driving method thereof capable of reducing a manufacturing cost of a driver wherein the driver applies a drive current to an organic light emitting diode of a pixel via a column line.

In one embodiment of the present invention, an organic light emitting display includes a plurality of column lines adapted to receive a drive current, each of the column lines belonging to one of a plurality of groups. A plurality of row lines are adapted to receive a scan signal. A plurality of organic light emitting diodes of a plurality of pixels are located at crossings of the row lines and the column lines. A scan driver is for applying the scan signal to the row lines. A data driver includes a common current source and a plurality of drive switching elements. The common current source is adapted to apply the drive current to the column lines in one of the groups. The drive switching elements are electrically connected to the common current source and are adapted to apply the drive current to the column lines in said one of the groups within a drive period in which the scan signal is applied. A plurality of charge switches are electrically connected to the column lines, the charge switches being turned-on before the drive current is applied to the column lines, and being turned-off during the drive period. A voltage retaining circuit coupled with the charge switches is for preliminarily charging the pixels.

According to a second embodiment of the present invention, there is provided a method for driving an organic light emitting display including a plurality of column lines adapted to receive a drive current, each of the column lines belonging to one of a plurality of groups, a plurality of row lines adapted to receive a scan signal, and an organic light emitting diode in at least one pixel, which is located at a crossing of one of the row lines and one of the column lines. The at least one pixel is adapted to receive the drive current and to emit light. The method includes the steps of applying the drive current from a common current source to the column lines in one of the groups in a time-division manner and preliminarily charging the at least one pixel before the drive current is applied to the column lines in said one of the groups.

BRIEF DESCRIPTION OF THE DRAWINGS

These and/or other aspects and features of the invention will become apparent and more readily appreciated from the following description of embodiments of the present invention, taken in conjunction with the accompanying drawings of which.

DETAILED DESCRIPTION

Figure 1:
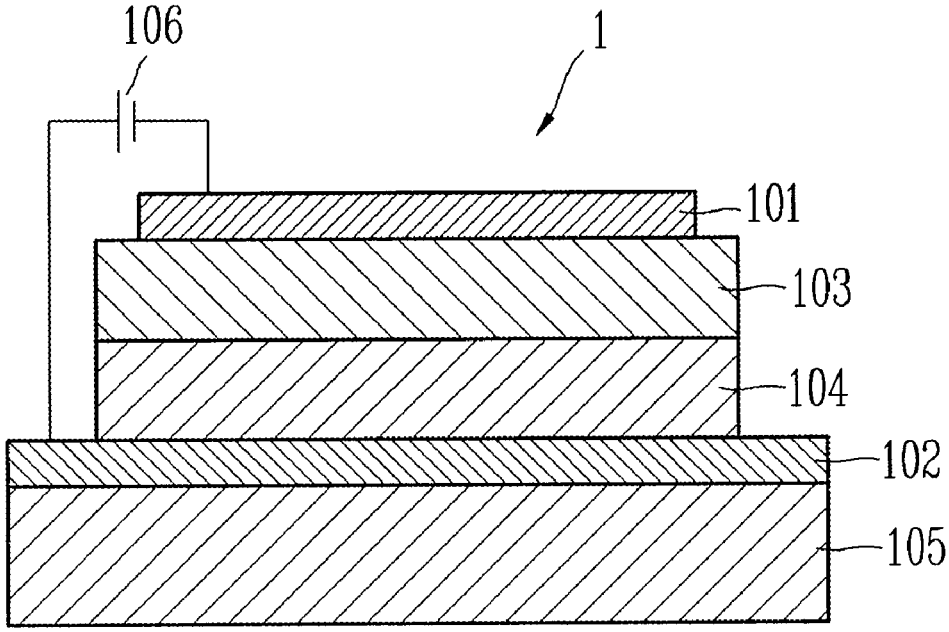
FIG. 1 (Prior Art)
FIG. 1 is a cross-sectional view showing a pixel of a conventional organic light emitting display.
Figure 2:
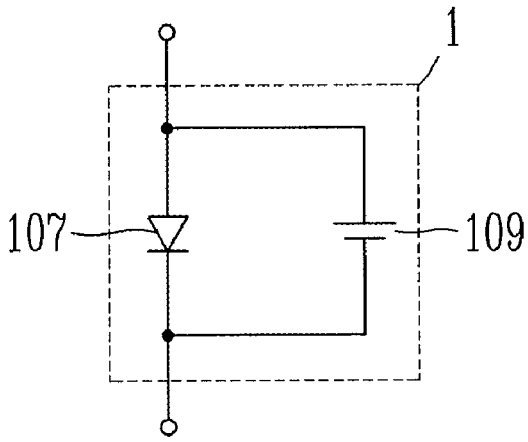
FIG. 2 (Prior Art)
FIG. 2 is an equivalent circuit diagram of the pixel shown in FIG. 1.

Hereinafter, embodiments according to the present invention will be described with reference to the accompanying drawings. Here, when a first element is described as being connected to a second element, the first element may not only be directly connected to the second element but may alternately be indirectly connected to the second element via a third element. Further, elements that are not essential to the complete understanding of the invention are not shown to improve clarity. Also, like reference numerals refer to like elements throughout.

Figure 5:
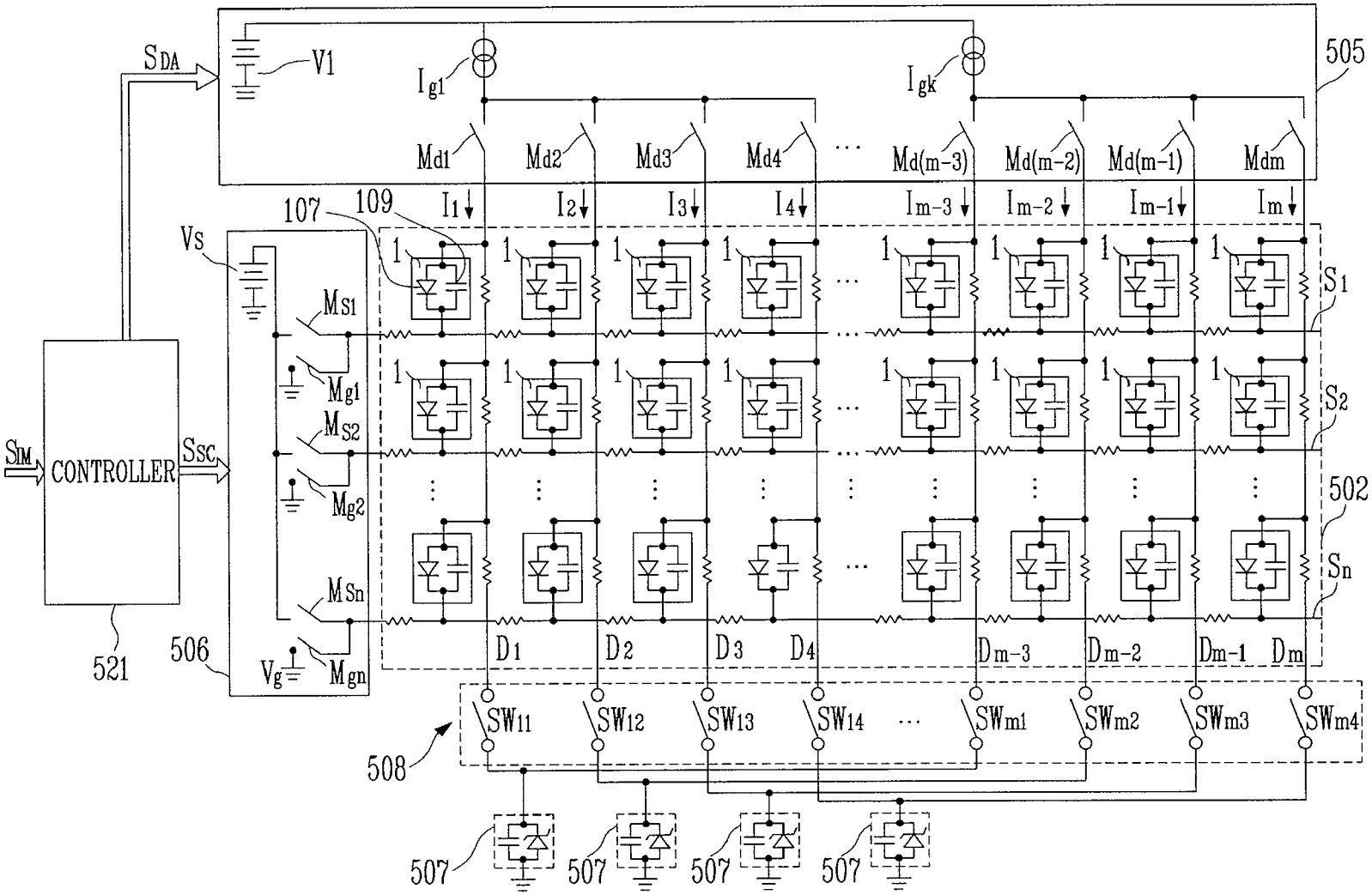
FIG. 5 is a schematic diagram showing an organic light emitting display according to an embodiment of the present invention.
Figure 6:
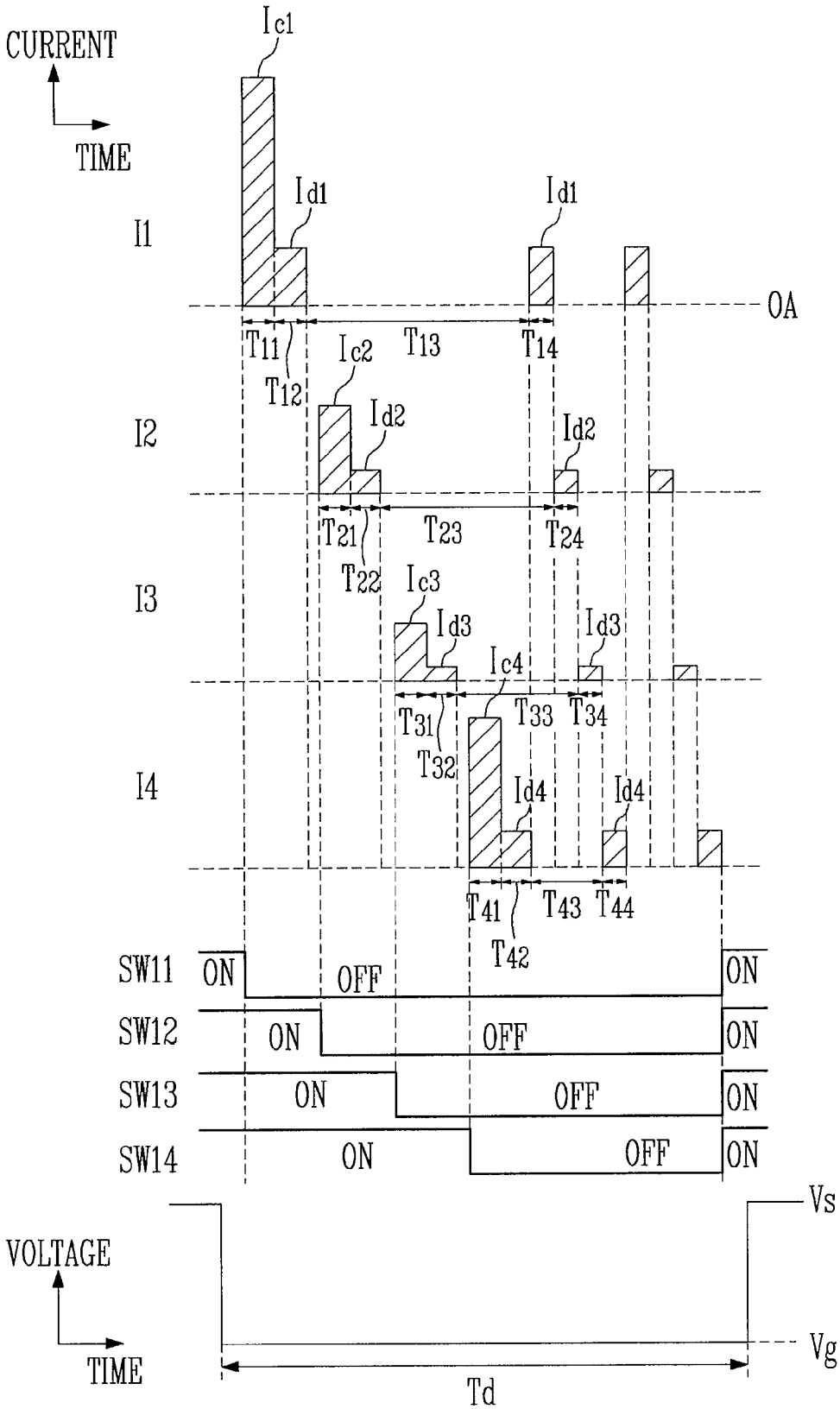
FIG. 6 is a timing diagram showing drive currents applied via column lines of FIG. 5 and an operation of a charge switch.

FIG. 5 is a schematic diagram showing an organic light emitting display according to an embodiment of the present invention. FIG. 6 is a timing diagram showing drive currents applied via column lines of FIG. 5 and an operation of a charge switch.

Referring to FIG. 5, the organic light emitting display in one embodiment includes an organic light emitting display panel 502, a controller 521, a scan driver 506, a data driver 505, a charge switch 508, and voltage retaining circuits 507.

The organic light emitting display panel 502 includes column lines D1, D2, . . . , Dm, row lines S1, S2, . . . , Sn, and pixels 1. The column lines D1, D2, . . . , Dm and the row lines S1, S2, . . . , Sn cross each other at certain intervals which may be predetermined. As shown in FIG. 5, organic light emitting diodes of the pixels 1 are formed at crossings of the column lines D1, D2, . . . , Dm and the row lines S1, S2, . . . , Sn.

Each of the pixels 1 includes a metal electrode, a transparent electrode, an organic phosphorous layer, and an organic hole transport layer. The metal electrode functions as a cathode, and the transparent electrode functions as an anode. The organic phosphorous layer and the organic hole transport layer are laminated between the metal electrode and the transparent electrode. The organic phosphorous layer and the organic hole transport layer are made of organic compounds.

When a voltage is applied between the metal electrode and the transparent electrode, excitons are generated due to recombination between electrons and holes, which are respectively introduced from the metal electrode and the transparent electrode. When the excitons transition from an excited state to a ground state, light is emitted. The emitted light is discharged through the transparent electrode and a glass substrate.

Here, since the pixel 1 includes a structure in which the organic phosphorous layer is laminated between the electrodes, an equivalent electric circuit thereof has parasitic capacitances. Accordingly, the pixel 1 includes an illuminant (or a light emitting element) 107 and a parasitic capacitance 109, which are connected with each other in parallel.

The controller 521 processes externally inputted image signals $S_{IM}$, and provides data control signals $S_{DA}$ and scan control signals $S_{SC}$ to the data driver 505 and the scan driver 506, respectively. Here, the data control signals $S_{DA}$ include data signals, and the scan control signals $S_{SC}$ include switching control signals to generate a scan signal.

The data driver 505 is electrically connected to the column lines D1, D2, . . . , Dm. The data driver 505 generates and provides a drive current corresponding to the data signals from the controller 521 to the column lines D1, D2, . . . , Dm according to the data control signals $S_{DA}$ from the controller 521.

In a conventional organic light emitting display, drive currents output from current sources I1, I2, . . . , Im in the data driver 5 (see, for example, FIG. 3) are provided to respective column lines D1, D2, . . . , Dm. However, in embodiments of the present invention, in order to reduce a manufacturing cost of a data driver, the column lines D1, D2, . . . , Dm are grouped as a plurality of groups, e.g., k groups. That is, each of the column lines belong to one of the groups. A drive current from one common current source is supplied to the column lines in one group.

Here, the data driver 505 of embodiments of the present invention performs a switching operation such that drive currents from one of common current sources $I_{g1}$, $I_{g2}$, . . . , $I_{gk}$ are applied to the respective group of column lines in a time-division manner. The data driver 505 includes drive switching elements, which are connected between the common current sources and the respective column lines.

In the embodiment shown in FIG. 5, first column line D1, second column line D2, third column line D3, and fourth column line D4 form one group. A first switching element $M_{d1}$, a second switching element $M_{d2}$, a third switching element $M_{d3}$, and a fourth switching element $M_{d4}$ are connected between a first common current source Ig1 and the first column line D1, the second column line D2, the third column line D3, and the fourth column line D4, respectively, such that a drive current from the first common current source Ig1 can be applied to the one group in a time-division manner.

That is, FIG. 5 shows an organic light emitting display wherein m column lines are divided into k groups by forming 4 column lines connected to a unit pixel as one group. In one embodiment, a red (R) emission pixel, a green (G) emission pixel, a blue (B) emission pixel, and a white (W) emission pixel form the unit pixel.

However, embodiments of the present invention are not limited thereto. That is, the number of column lines that form one group can vary.

By way of example, when a red (R) emission pixel, a green (G) emission pixel, and a blue (B) emission pixel form the unit pixel, 3 column lines are grouped as one group. In one embodiment, a drive current from a common current source is applied to a red (R) pixel on which a red (R) phosphorous layer is laminated, a green (G) pixel on which a green (G) phosphorous layer is laminated, and a blue (B) pixel on which a blue (B) phosphorous layer is laminated in a time-division manner.

In one embodiment, since a plurality of column lines are connected to one common current source, a drive current from the common current source is sequentially applied to the plurality of column lines. Here, while the drive current is applied to one column line, the drive current is not applied to other column lines. This will be described in more detail with reference to FIG. 6 later.

The scan driver 506 is electrically connected to row lines S1, S2, . . . , Sn. The scan driver 506 sequentially provides a scan signal to the row lines S1, S2, . . . , Sn according to switching control signals from the controller 521. The scan signal has a high level Vs and a low level Vg. The scan signal maintains the high level Vs by default. During a drive period Td of driving a row line, however, the scan signal becomes the low level Vg.

Here, the scan driver 506 includes a first scan voltage source Vs, first scan switching elements $M_{s1}$, $M_{s2}$, . . . , $M_{sn}$, a second scan voltage source Vg, and second scan switching elements $M_{g1}$, $M_{g2}$, . . . , $M_{gn}$. The first scan voltage source Vs provides a signal of a high level Vs. The first scan switching elements $Ms_1$, $Ms_2$, . . . , $M_{sn}$ are electrically connected to the first scan voltage source Vs, and transfer the signal of a high level Vs to the row lines S1, S2, . . . , Sn. The second scan voltage source Vg provides a voltage of a low level Vg. The second scan switching elements Mg1, Mg2, . . . , Mgn are electrically connected to the second scan voltage source Vg, and transfer the voltage of a low level Vg to the row lines S1, S2, . . . , Sn.

That is, the first scan switching elements $M_{s1}$, $M_{s2}$, . . . , $M_{sn}$ are turned-on and the second scan switching elements $M_{g1}$, $M_{g2}$, . . . , $M_{gn}$ are turned-off to provide the signal of a high level Vs to the row lines S1, S2, . . . , Sn. In contrast to this, during the drive period Td, the first scan switching elements $M_{s1}$, $M_{s2}$, . . . , $M_{sn}$ are turned-off and the second scan switching elements $M_{g1}$, $M_{g2}$, . . . , $M_{gn}$ are turned-on to provide the signal of a low level Vg to the row lines S1, S2, . . . , Sn.

In one embodiment, the first scan voltage source Vs of a high level has a level similar to that of a drive voltage source V1 in a data driver (see, for example, the data driver 505 in FIG. 5), and the first scan switching elements $M_{s1}$, $M_{s2}$, . . . , $M_{sn}$ are turned-on to apply the voltage of a high level Vs to the row lines S1, S2, . . . , Sn. Accordingly, because there is substantially no potential difference between an anode and a cathode of each diode connected thereto, each diode does not emit light. In contrast, during a drive period of each pixel, a scan voltage provided to a row line corresponds to a second scan voltage source Vg of a low level.

Here, as shown in FIG. 5, the low level Vg may be a voltage ground GND. Hereinafter, a ground voltage may be referred to as 'low level'.

During the drive period Td, a ground voltage Vg, GND is applied to the row line, and a drive current is applied to a column line, such that the drive current flows to a ground terminal through a pixel, with the result that the pixel emits light.

In addition, referring to FIG. 5, in an embodiment of the present invention, respective column lines are connected to voltage retaining circuits 507 through a charge switch 508.

Here, each of the voltage retaining circuits 507 corresponds to column lines, which are connected to pixels emitting lights of the same color.

In more detail, as shown in FIG. 5, four voltage retaining circuits 507 are provided corresponding to groups of column lines, which are connected to pixels emitting lights of red (R), green (G), blue (B), and white (W) colors, respectively. A charge switch 508 connected to the respective column lines is coupled with the voltage retaining circuits 507, which are installed (or positioned) corresponding to respective colors.

The voltage retaining circuit 507 functions to generate a bias voltage, and includes a Zener diode and a parallel capacitor. However, it is not essential that the parallel capacitor be included therein.

In one embodiment, the voltage retaining circuit 507 is constructed by a voltage regulation source, which generates a voltage which may be predetermined. In one embodiment, the voltage is a voltage corresponding to a black level of the organic light emitting display.

In one embodiment, an anode of a Zener diode can be connected to the column lines, and a cathode thereof is connected to ground. Charge switches 508 connect the voltage retaining circuits 507 and the column lines. The charge switches 508 turn-on/off connections of the column lines and the voltage retaining circuits 507. Here, a potential of the Zener diode is high such that it is possible to determine a black level of each color.

That is, when the charge switch 508 connected to respective voltage retaining circuits 507 positioned according to colors is turned-on, the respective voltage retaining circuits 507 couple column lines connected to pixels emitting light of the same color with each other. As a result, the column lines are coupled with an anode side of the Zener diode of a corresponding voltage retaining circuit 507.

However, before a drive current is applied to the column line, the corresponding charge switch 508 is turned-on. Turing-on of the charge switch 508 reduces a charge current supplied to an organic light emitting diode, which is connected to a row line not selected when row lines are switched.

Accordingly, a charge flows from an organic light emitting diode which was driven and emitted light, such that other coupled organic light emitting diodes are charged. Voltages at anode sides of the other organic light emitting diodes are determined by the voltage retaining circuits and maintain a potential VH, which may be predetermined. The potential VH is a voltage at which an organic light emitting diode reaches a black level. The organic light emitting diode includes a cathode, which is connected to ground. Accordingly, pixels connected to the data lines and emitting light of the same color are preliminarily charged to become a black level.

Hereinafter, a method for driving an organic light emitting display according to an embodiment of the present invention will be described in more detail referring to FIG. 6.

Each of a plurality of column lines belong to one of a plurality of groups. A drive current from a common current source is applied to the column lines in one group. Here, the drive current is sequentially applied to column line by column line such that application of the drive current to the individual column lines do not overlap with each other over time. Concurrently, the corresponding charge switch is turned-on prior to applying the drive current to preliminarily charge pixels coupled with column lines in the one group.

In addition, the drive currents I1, I2, . . . , Im are divided into first drive currents Ic1, Ic2, . . . , Icm for charging a parasitic capacitance of a pixel and second drive currents Id1, Id2, . . . , Idm which are supplied to an illuminant of the pixel. To sequentially apply the drive currents to column lines of the same group, embodiments of the present invention use a method of intermittently applying the drive current thereto.

That is, in embodiments of the present invention, the pixels are preliminarily charged and the first drive current is provided through the charge switch and the voltage retaining circuit, thereby quickly charging a parasitic capacitance of each pixel.

As shown in FIG. 6, when first to fourth column lines D1 to D4 are grouped as a first group G1, a first drive current Ic1 is applied during a time period T11 and a second drive current Id1 is applied during a time period T12. No currents are applied to the second to fourth column lines D2 to D4 during the time periods T11 and T12.

Next, a first drive current Ic2 is applied to the second column line D2 during a time period T21, and a second drive current Id2 is applied to the second column line D2 during a time period T22. No currents are applied to the first, third and fourth column lines D1, D3 and D4 during the time periods T21 and T22.

Next, a first drive current Ic3 is applied to the third column line D3 during a time period T31, and a second drive current Id3 is applied to the third column line D3 during a time period T32. No currents are applied to the first, second and fourth column lines D1, D2 and D4 during the time periods T31 and T32.

Thereafter, a first drive current Ic4 is applied to the fourth column line D4 during a time period T41, and a second drive current Id4 is applied to the fourth column line D4 during a time period T42. No currents are applied to the first to third column lines D1 to D3 during the time periods T41 and T42.

The application of the drive current, as described above, is performed by turning-on/off operation of the first to fourth drive switching elements $M_{d1}$ to $M_{d4}$, which are connected to the first common current source Ig1.

In one embodiment, the drive currents I1 to I4 are respectively applied to the first to fourth column lines D1 to D4, as described above, to cause each pixel to emit light. In another embodiment, drive current, that is, second drive currents Id1 to Id4 is further applied to each pixel.

In more detail, after the time period T42, a second drive current Id1 is applied to the first column line D1 during a time period T14. No currents are applied to the second to fourth column lines D2 to D4 during the time period T14.

After the time period T14, a second drive current Id2 is applied to the second column line D2 during a time period T24. No currents are applied to the first, third, and fourth column lines D1, D3, and D4 during the time period T24.

After the time period T24, a second drive current Id3 is applied to the third column line D3 during a time period T34. No currents are applied to the first, second and fourth column lines D1, D2 and D4 during the time period T34.

After the time period T34, a second drive current Id2 is again applied to the fourth column D4 during a time period T44. No currents are applied to the first to third column lines D1 to D3 during the time period T44. In one embodiment, e.g., when the drive currents I1 to I4 applied to each pixel are insufficient, time periods such as the time periods T14 to T44 can be repeated according to any of various suitable cycles.

In one embodiment, the first to fourth column lines D1 to D4 are grouped as a first group G1. A first charge switch SW11 (see, for example, FIG. 5) connected to the first column line D1 is turned-on before a drive current is applied to the first column line D1. In contrast to this, during most of the drive period Td of FIG. 6, the first charge switch SW11 is turned-off. In addition, a second charge switch SW12 connected to the second column line D2 is turned-on before a drive current is applied to the second column line D2. In contrast to this, during most of a remaining portion of the drive period, the second charge switch SW12 is turned-off.

In a substantially similar manner, a third charge switch SW13 connected to the third column line D3 is turned-on before the drive current is applied to the third column line D3. In contrast to this, during most of a remaining portion of the drive period, the third charge switch SW13 is turned-off. In addition, a fourth charge switch SW14 connected to the fourth column line D4 is turned-on before the drive current is applied to the fourth column line D4. In contrast to this, during most of a remaining portion of the drive period, the fourth charge switch SW14 is turned-off.

As described above, respective pixels connected to the column lines are preliminarily charged through a respective voltage retaining circuit 507 by a turning-on/off operation of the charge switches 508.

In one embodiment, during the drive period Td, the first drive currents Ic1, Ic2, . . . , Icm are respectively applied to the column lines D1, D2, . . . , Dm during the first periods T11, . . . , Tm1, the second drive currents Id1, Id2, . . . , Idm are respectively applied thereto during the second periods T12, . . . , Tm2, and no currents are applied to a corresponding one of the column lines D1, D2, . . . , Dm during third periods T13, . . . , Tm3. The second drive currents Id1, Id2, . . . , Idm are again applied thereto during the fourth periods T14, . . . , Tm4. The third periods T13, . . . , Tm3 and the fourth periods T14, . . . , Tm4 are repeated until the drive period Td is terminated.

In embodiments of the present invention, after the first drive current is applied to one column line during the drive period Td, the second drive current is intermittently applied. The drive method according to embodiments of the present invention, as described above, is different from a conventional drive method, but they do not substantially differ from each other with respect to light emission of a pixel.

In one embodiment, the second drive currents Id1, Id2, . . . , Idm are respectively applied to the column lines D1, D2, . . . , Dm before the first periods T11, . . . , Tm1 during the drive period Td. That is, when the second drive currents Id1, Id2, . . . , Idm are applied ahead of the first drive currents Ic1, Ic2, . . . , Icm, and the first drive currents Ic1, Ic2, . . . , Icm are gradually increased, a loss of a circuit device in the driving circuit may be prevented.

In the driving method according to embodiments of the present invention, a plurality of column lines belong to one group, and a drive current from a common current source is sequentially applied to the one group in such a way that the drive current is intermittently applied to one column line. However, embodiments of the present invention are not limited thereto. For example, respective drive currents from respective current sources can be intermittently applied to respective column lines.

Figure 3:
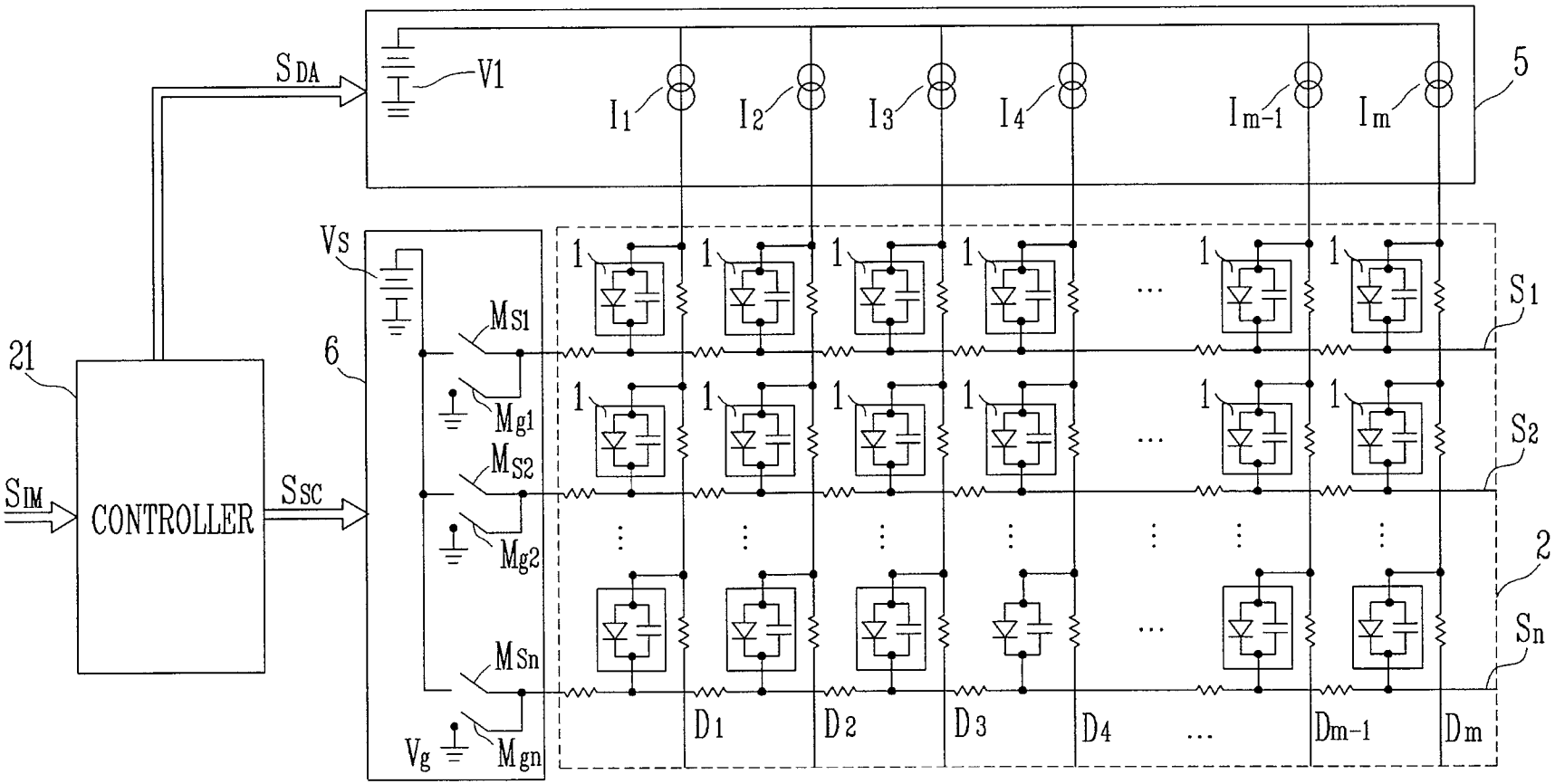
FIG. 3 (Prior Art)
FIG. 3 is a schematic view showing a conventional organic light emitting display.
Figure 4:
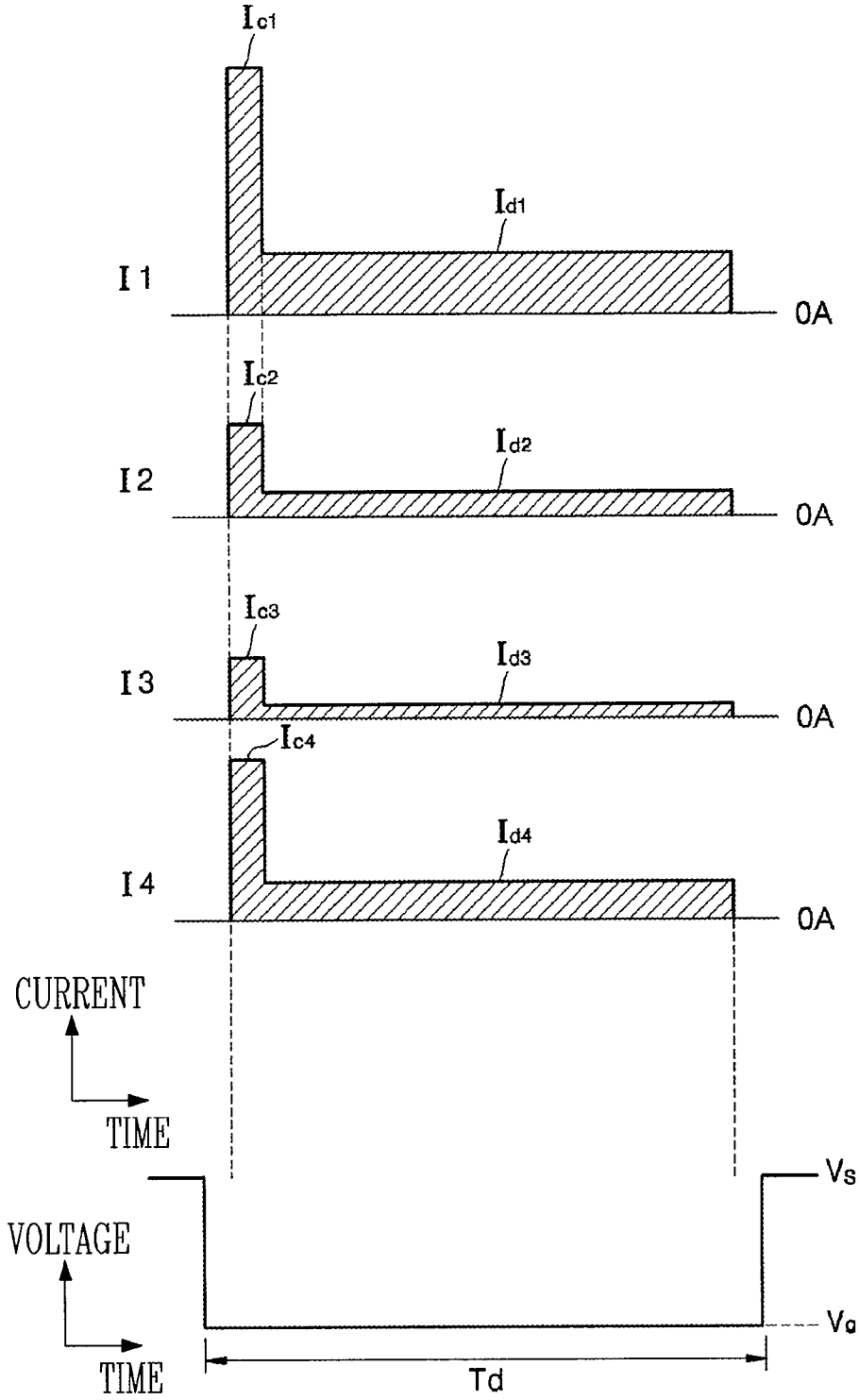
FIG. 4 (Prior Art)
FIG. 4 is a timing diagram showing application of a drive current for driving the organic light emitting display shown in FIG. 3.

In more detail, in the organic light emitting display having a connection construction of column lines, as shown in FIG. 3, and a current source, a drive current I1 applied to a first column line of FIG. 6 may be intermittently applied to each pixel.

As described above, embodiments of the present invention may have certain features as follows.

In embodiments of the organic light emitting display, since the number of current sources providing a drive current applied to respective column lines is reduced, a manufacturing cost of a data driver is reduced, and accordingly a total manufacturing cost of the organic light emitting display can be lowered.

In addition, although a drive current is intermittently applied to respective pixels, the respective pixels emit light according to the applied drive current, thereby preventing a performance of emission characteristics thereof from being deteriorated.

Although a few embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:

a plurality of column lines adapted to receive a drive current, each of the column lines belonging to one of a plurality of groups;

a plurality of row lines adapted to receive a scan signal;

a plurality of organic light emitting diodes of a plurality of pixels, which are located at crossings of the row lines and the column lines;

a scan driver for applying the scan signal to the row lines;

a data driver including a common current source and a plurality of drive switching elements, the common current source being adapted to apply the drive current to the column lines in one of the groups, and the drive switching elements being electrically connected to the common current source and being adapted to apply the drive current to the column lines in said one of the groups within a drive period in which the scan signal is applied;

a plurality of charge switches electrically connected to the column lines, the charge switches being turned-on before the drive current is applied to the column lines, and being turned-off during the drive period; and a voltage retaining circuit coupled with the charge switches, for preliminarily charging the pixels, wherein the drive current comprises a first driving current applied to one of the column lines during a first period of the drive period, and a second driving current applied to the one of the column lines during a second period of the drive period, wherein the second driving current has a lower magnitude than a magnitude of the first driving current, wherein the drive current is not applied to the one of the column lines during a third period of the drive period, and wherein the second driving current is applied to the one of the column lines during a fourth period of the drive period.

2. The organic light emitting display as claimed in claim 1, wherein the voltage retaining circuit includes four circuits corresponding to the column lines, which are connected to the pixels for emitting lights of red (R), green (G), blue (B), and white (W) colors, respectively.

3. The organic light emitting display as claimed in claim 1, wherein the voltage retaining circuit includes three circuits corresponding to the column lines, which are connected to the pixels for emitting lights of red (R), green (G), and blue (B) colors, respectively.

4. The organic light emitting display as claimed in claim 1, wherein the voltage retaining circuit includes a voltage regulation element for maintaining a voltage and a capacitor electrically connected with the voltage regulation element in parallel.

5. The organic light emitting display as claimed in claim 4, wherein the voltage maintained by the voltage regulation element is a voltage corresponding to a black level of the organic light emitting display.

6. The organic light emitting display as claimed in claim 4, wherein the voltage regulation element comprises a Zener diode.

7. The organic light emitting display as claimed in claim 1, wherein the voltage retaining circuit comprises a voltage regulation source.

8. The organic light emitting display as claimed in claim 1, wherein the drive period further comprises a time period in which the drive current is not applied to the one of the column lines and a time period in which the second driving current is applied to the one of the column lines, after the fourth period.

9. The organic light emitting display as claimed in claim 1, wherein the scan driver comprises:

a first scan voltage source for supplying a signal of a high level;

a first scan switching element electrically connected to the first scan voltage source and adapted to be turned-on to apply the signal of a high level to the row lines;

a second scan voltage source for supplying a signal of a low level; and a second scan switching element electrically connected to the second scan voltage source and adapted to be turned-on to apply the signal of a low level to the row lines, wherein the first scan switching element is turned-off and the second scan switching element is turned-on during the drive period.

10. The organic light emitting display as claimed in claim 1, wherein, while the drive current is applied to one of the column lines in said one of the groups, the drive current is not applied to other of the column lines in said one of the groups.

11. A method for driving an organic light emitting display including a plurality of column lines adapted to receive a drive current, each of the column lines belonging to one of a plurality of groups, a plurality of row lines adapted to receive a scan signal, and an organic light emitting diode in at least one pixel, which is located at a crossing of one of the row lines and one of the column lines, the at least one pixel being adapted to receive the drive current and to emit light, the method comprising:

applying the drive current from a common current source to the column lines in one of the groups in a time-division manner during a drive period;

preliminarily charging the at least one pixel before the drive current is applied to the column lines in said one of the groups; and providing the drive current to the organic light emitting diode, wherein the drive current comprises a first driving current and a second driving current, wherein the drive period comprises a first period, a second period, a third period, and a fourth period, wherein the first driving current is applied to one of the column lines during the first period, wherein the second driving current is applied to the one of the column lines during the second period, the second driving current having a lower magnitude than a magnitude of the first driving current, wherein the drive current is not applied to the one of the column lines during the third period, and wherein the second driving current is applied to the one of the column lines during the fourth period.

12. The method as claimed in claim 11, wherein the drive current is intermittently applied to the column lines in said one of the groups during the drive period.

13. The method as claimed in claim 11, wherein the drive period further comprises a time period in which the drive current is not applied to the one of the column lines and a time period in which the second driving current is applied to the one of the column lines, after the fourth period.

14. The method as claimed in claim 11, wherein the second driving current is applied to the one of the column lines before the first period.

15. The method as claimed in claim 11, wherein the respective magnitudes of the first and second driving currents vary among the at least one pixel.

16. The method as claimed in claim 11, wherein, while the drive current is applied to one of the column lines in said one of the groups, the drive current is not applied to other of the column lines in said one of the groups.

17. The method as claimed in claim 11, wherein the column lines in said one of the groups are connected to the pixels for emitting lights of red (R), green (G), blue (B), and white (W) colors, respectively.

18. The method as claimed in claim 11, wherein the column lines in said one of the groups are connected to the pixels for emitting lights of red (R), green (G), and blue (B) colors, respectively.

19. The organic light emitting display as claimed in claim 1:

wherein, for one group of the plurality of groups, non-active column lines in the one group comprise the column lines other than the one of the column lines; and wherein, during the first and second periods, the drive current received by the non-active column lines is about equal to zero.

* * * * *